US009944078B2

(12) United States Patent
Kobayashi et al.

(10) Patent No.: US 9,944,078 B2
(45) Date of Patent: Apr. 17, 2018

(54) LIQUID DISCHARGE HEAD AND RECORDING DEVICE USING THE SAME

(71) Applicant: KYOCERA Corporation, Kyoto-shi, Kyoto (JP)

(72) Inventors: Naoki Kobayashi, Kirishima (JP); Yuka Kushima, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/545,463

(22) PCT Filed: Jan. 23, 2016

(86) PCT No.: PCT/JP2016/051945
§ 371 (c)(1),
(2) Date: Jul. 21, 2017

(87) PCT Pub. No.: WO2016/117707
PCT Pub. Date: Jul. 28, 2016

(65) Prior Publication Data

US 2017/0368820 A1 Dec. 28, 2017

(30) Foreign Application Priority Data

Jan. 23, 2015 (JP) ..... 2015-011433

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2002/14306
See application file for complete search history.

(56) References Cited

U.S. PATENT DOCUMENTS

2008/0143793 A1* 6/2008 Okuda ..... B41J 2/14233 347/68
2011/0316948 A1* 12/2011 Asami ..... B41J 2/14233 347/92

FOREIGN PATENT DOCUMENTS

JP 2009-143168 A 7/2009

* cited by examiner

*Primary Examiner* — Alessandro Amari
*Assistant Examiner* — Scott A Richmond
(74) *Attorney, Agent, or Firm* — Volpe and Koenig, P.C.

(57) ABSTRACT

A liquid discharge head of the present disclosure includes a flow path member having a plurality of discharge holes, a plurality of pressure chambers, a plurality of first common flow paths, a plurality of second common flow paths, and a plurality of pressure sections. The first common flow paths and the second common flow paths are linked through a connection flow path outside a connection range C, the connection range C being linked through the pressure chambers. The flow path member is configured by laminating a plurality of flat plates. The connection flow path includes holes and/or grooves disposed in plates other than the common flow path plates that constitute the first common flow paths and the second common flow paths.

4 Claims, 9 Drawing Sheets

LIQUID DISCHARGE HEAD AND RECORDING DEVICE USING THE SAME

TECHNICAL FIELD

The present disclosure relates to a liquid discharge head, and a recording device using the liquid discharge head.

BACKGROUND ART

Conventionally, a conventional liquid discharge head that discharges liquid onto a recording medium to carry out various types of printing has been known as a printing head. For example, the liquid discharge head is known which includes discharge holes that discharge liquid, pressure chambers that press the liquid to be discharged from the discharge holes, first common flow paths that supply the liquid to the pressure chambers, and second common flow paths that collect the liquid from the pressure chambers. It is known that, even while not being discharged, the liquid flows from the first common flow paths to the second common flow paths through the pressure chambers such that the flow paths are not clogged by liquid stagnation, in order to circulate the liquid including outside. In such liquid discharge head, the plurality of first common flow paths and the plurality of second common flow paths extend in the transverse direction of the liquid discharge head, and are alternately arranged in the longitudinal direction of the liquid discharge head. Further, a flow path member having the pressure chambers, the first common flow paths, and the second common flow paths is configured by laminating plates with hole (Refer to Patent Document 1, for example).

RELATED ART DOCUMENT

Patent Document

Patent Document 1: Japanese Laid-open Publication No. 2009-143168

SUMMARY OF THE INVENTION

A liquid discharge head of the present disclosure includes a flow path member having a plurality of discharge holes, a plurality of pressure chambers linked to the respective discharge holes, a plurality of first common flow paths, and a plurality of second common flow paths, and a plurality of pressure sections that press the respective pressure chambers. When the liquid discharge head is viewed in a plan view, the first common flow paths and the second common flow paths extend in a first direction, and are alternately arranged in a second direction that crosses the first direction. When the liquid discharge head is viewed in a plan view, the first common flow paths are opened to the outside of the flow path member at ends in the first direction, and are not opened to outside of the flow path member at ends in a third direction that is opposite to the first direction. When the liquid discharge head is viewed in a plan view, the second common flow paths are opened to the outside of the flow path member at an end of the third direction, and are not opened to the outside of the flow path member at an end of the first direction. The plurality of pressure chambers are disposed between the first common flow paths and the second common flow paths that are adjacent to each other in the second direction, and the first common flow paths and the second common flow paths are linked via the plurality of the pressure chambers. In the first direction, given that a range in which the first common flow paths and the second common flow paths are linked via the plurality of the pressure chambers is a connection range, the first common flow paths and the second common flow paths are linked via connection flow paths outside the connection range in the first direction. The flow path member is configured by laminating a plurality of flat plate including at least one of holes and grooves. The flow path member includes a first plate having at least one of the holes and grooves that constitute the connection flow path and having at least one of the holes and grooves that constitute the first common flow paths and second common flow path, and a second plate having at least one of the holes and grooves that constitute the connection flow paths and having no hole and groove that constitute the first common flow paths and second common flow path.

A recording device of the present disclosure includes the liquid discharge head, a conveyance unit that conveys a recording medium to the liquid discharge head, and a control unit that controls the liquid discharge head.

EMBODIMENTS FOR CARRYING OUT THE INVENTION

In the liquid discharge head as described in Patent Document 1, the quantity of flowing liquid varies between at one ends and the other ends of first common flow paths and the second common flow paths. For example, at one ends of the first common flow paths, total flow quantity of liquid flows which flows through all of the pressure chambers linked to the first common flow paths, while at the other ends of the first common flow paths, total flow quantity of liquid flows which flows through one or two pressure chambers linked to the first common flow paths. At the other ends with lower flow quantity, the flow rate is lower and thus, often, solid contents in the liquid may settle and bubbles in the liquid may build up.

To solve the problem, one ends of the first common flow paths can be linked to the second common flow paths. However, in doing so, in the flow path member configured by laminating plates, when holes are formed in the plates such that the first common flow paths are linked to the second common flow path in the shortest distance, a part of the plates is not connected to surroundings, making production difficult.

Figure 1A:
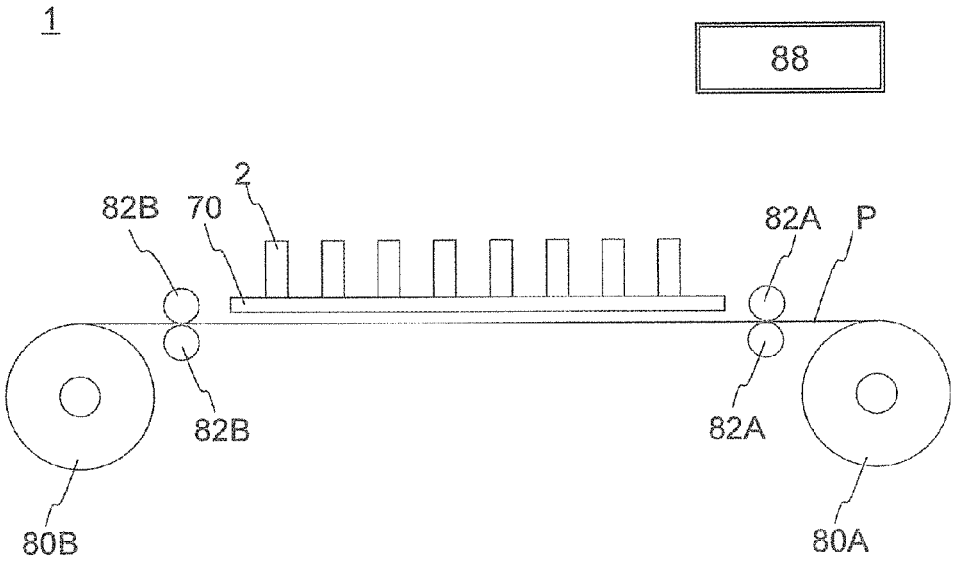
FIG. 1(*a*) is a side view of a recording device including liquid discharge heads according to an embodiment of the present disclosure, and FIG. 1(*b*) is a plan view of the recording device.
Figure 1B:
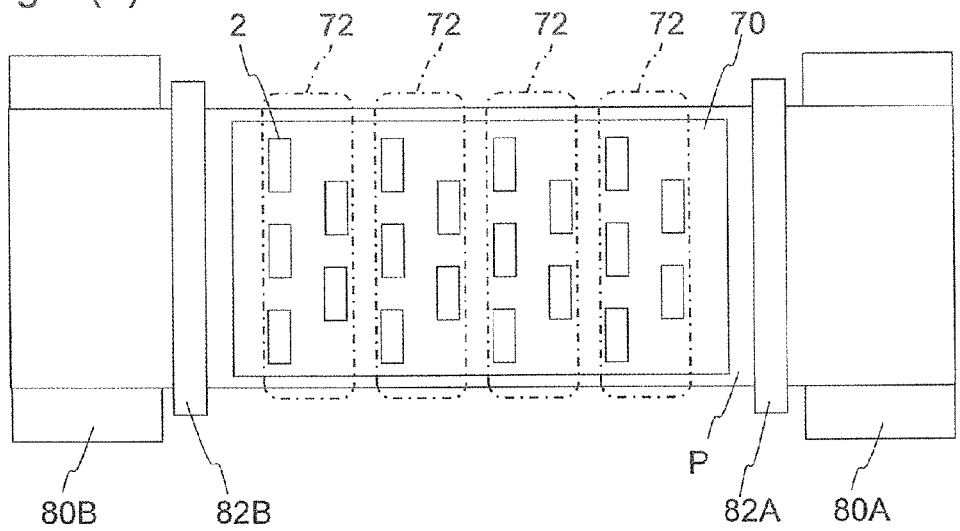

FIG. 1(*a*) is a schematic side view of a color ink jet printer 1 (also referred to as printer) that is a recording device including liquid discharge heads 2 according to the present disclosure, and FIG. 1(*b*) is a schematic plan view of the printer. The printer 1 conveys printing sheet P that is a recording medium from a conveyance roller 80A to a conveyance roller 80B, thereby transferring the printing sheet P relative to the liquid discharge heads 2. A control unit 88 controls the liquid discharge heads 2 on the basis of graphic or character data to discharge liquid toward the recording medium P, thereby applying droplets on the printing sheet P to perform recording such as printing on the printing sheet P.

In this embodiment, the liquid discharge heads 2 are fixed to the printer 1, and the printer 1 is a so-called line printer. In another embodiment of the recording device, the operation of reciprocating the liquid discharge heads 2 in the direction that crosses the conveyance direction of the printing sheet P, that is, is substantially orthogonal to the conveyance direction, and the operation of conveying the printing sheet P are alternately carried out. Thus, the recording device is a so-called serial printer.

A flat head-mounted frame 70 (also referred to as frame) is fixed to the printer 1 so as to be parallel to the printing sheet P. The frame 70 has 20 holes not illustrated, and the 20 liquid discharge heads 2 are mounted in the respective holes such that their liquid-discharging portions face the printing sheet P. A distance between the liquid discharge heads 2 and the printing sheet P is set to about 0.5 to 20 mm, for example. The five liquid discharge heads 2 constitute one head group 72, and the printer 1 has the four head groups 72.

The liquid discharge heads 2 are vertically oblong in the direction from the near side to the rear side in FIG. 1(*a*), and in the vertical direction in FIG. 1(*b*). The direction may be referred to the longitudinal direction. In one head group 72, the three liquid discharge heads 2 are arranged in the direction that crosses the conveyance direction of the printing sheet P, for example is substantially orthogonal to the conveyance direction, and the two remaining liquid discharge heads 2 each are displaced therefrom in the conveyance direction and disposed between the adjacent heads of the three liquid discharge heads 2. The liquid discharge heads 2 are disposed such that ranges that can be printed by the liquid discharge heads 2 are connected to each other or overlap each other at their ends in the width direction of the printing sheet P (direction that crosses the conveyance direction of the printing sheet P), enabling printing without any gap in the width direction of the printing sheet P.

The four head groups 72 are arranged in the conveyance direction of the printing sheet P. Liquid such as ink is supplied from a liquid tank not illustrated to each of the liquid discharge heads 2. Ink of the same color is supplied to the liquid discharge heads 2 that belong to the same head group 72, and the four head groups 72 enable printing with ink of four colors. Examples of the ink discharged from the head group 72 are magenta (M), yellow (Y), cyan (C), and black (K). The control unit 88 controls the colors of the ink, achieving printing of a colored image.

The number of the liquid discharge heads 2 mounted in the printer 1 may be one when one liquid discharge head 2 can print a monotone image to the printable range. The number of the liquid discharge heads 2 included in the head group 72 and the number of the head groups 72 may be changed according to objects to be printed and printing conditions as appropriate. For example, for printing in more colors, the number of the head groups 72 may be increased. In addition, by disposing a plurality of head groups 72 of the same color and alternatively operating the head groups in the conveyance direction, even the liquid discharge heads 2 having the same performance are used, the conveyance speed can be increased. This can increase the printing area per time. By preparing a plurality of head groups 72 of the same color and displacing them from each other in the direction that crosses the conveyance direction, the resolution in the width direction of the printing sheet P can be improved.

For surface treatment of the printing sheet P, liquid such as a coating agent, in place of color ink, may be printed.

The printer 1 makes printing on the printing sheet P that is a recording medium. The printing sheet P is wound around a feed roller 80A, passes between two guide rollers 82A, below the liquid discharge heads 2 mounted on the frame 70 and then, between two conveyance rollers 82B, and is finally collected by a collection roller 80B. In printing, the printing sheet P is conveyed at a certain rate with the rotation of the conveyance rollers 82B, and is printed using the liquid discharge heads 2. The collection roller 80B winds the printing sheet P sent from the conveyance rollers 82B. The conveyance rate is set to, for example, 50 m/minute. Each of the rollers may be controlled by the control unit 88 or may be manually operated.

The recording medium may be rolled fabric other than the printing sheet P. The printer 1 may directly convey a conveyance belt with the recording medium thereon, rather than the printing sheet P. In this case, the recording medium may be cut-sheet paper, cut fabric, wood and tile. Further, the liquid discharge heads 2 may discharge liquid including conductive particles to print a wiring pattern of electronic equipment. Alternately, the liquid discharge heads 2 may discharge a predetermined quantity of liquid chemical agent or liquid containing chemical agent to a reaction container to react with each other and to prepare a chemical product.

A position sensor, speed sensor, and temperature sensor may be installed in the printer 1, and the control unit 88 may control each unit of the printer 1 according to the state of each unit on the basis of information sent from each of the sensors. For example, in the case where the temperature of the liquid discharge heads 2, the temperature of liquid in a liquid tank, or the pressure applied by the liquid in the liquid tank to the liquid discharge heads 2 affects discharge properties (discharge quantity, discharge rate, and so on) of the discharged liquid, a driving signal to discharge the liquid can be changed according to the information.

Figure 2A:
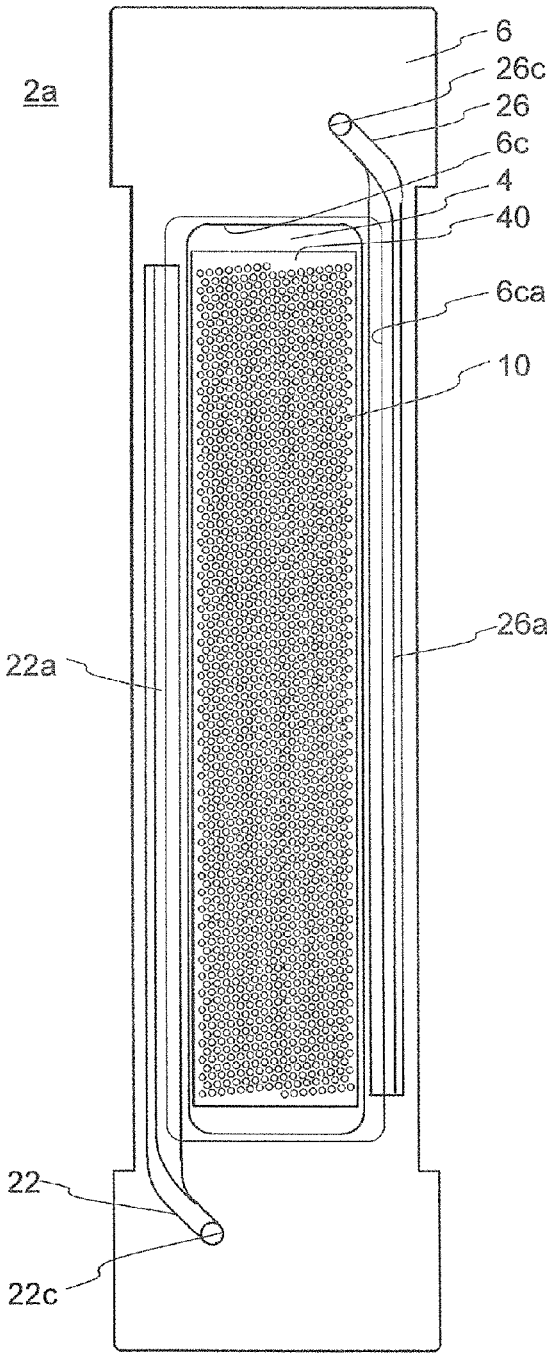
FIG. 2(*a*) is a plan view of a head body that is a main part of the liquid discharge head in FIG. 1, and FIG. 2(*b*) is a plan view of the head body without a second flow path member in FIG. 2(*a*).
Figure 2B:
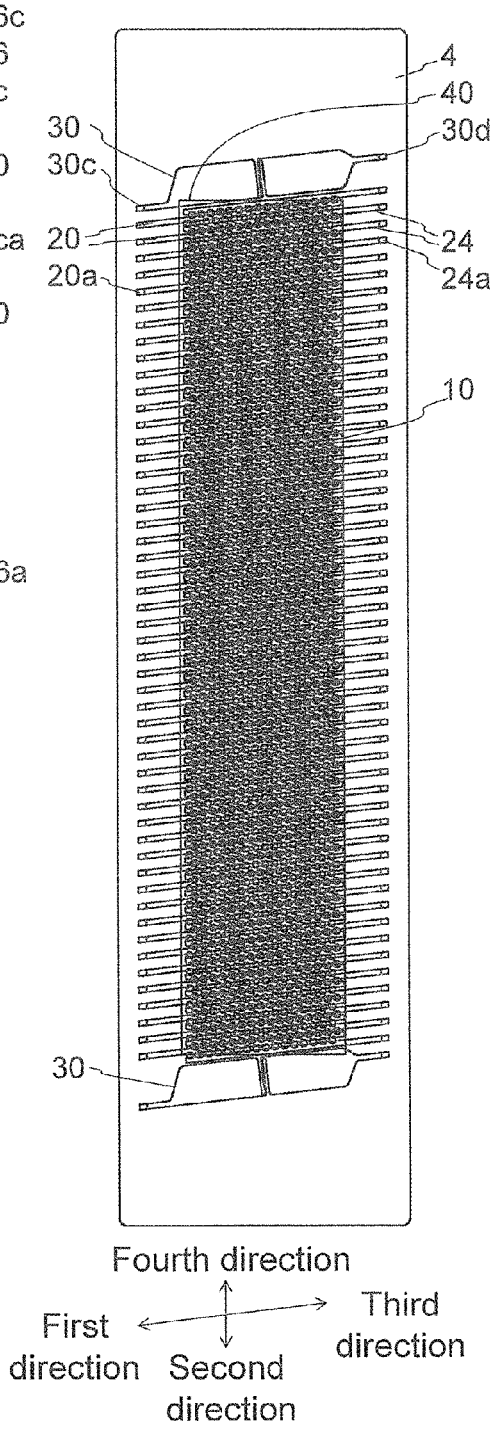
Figure 3:
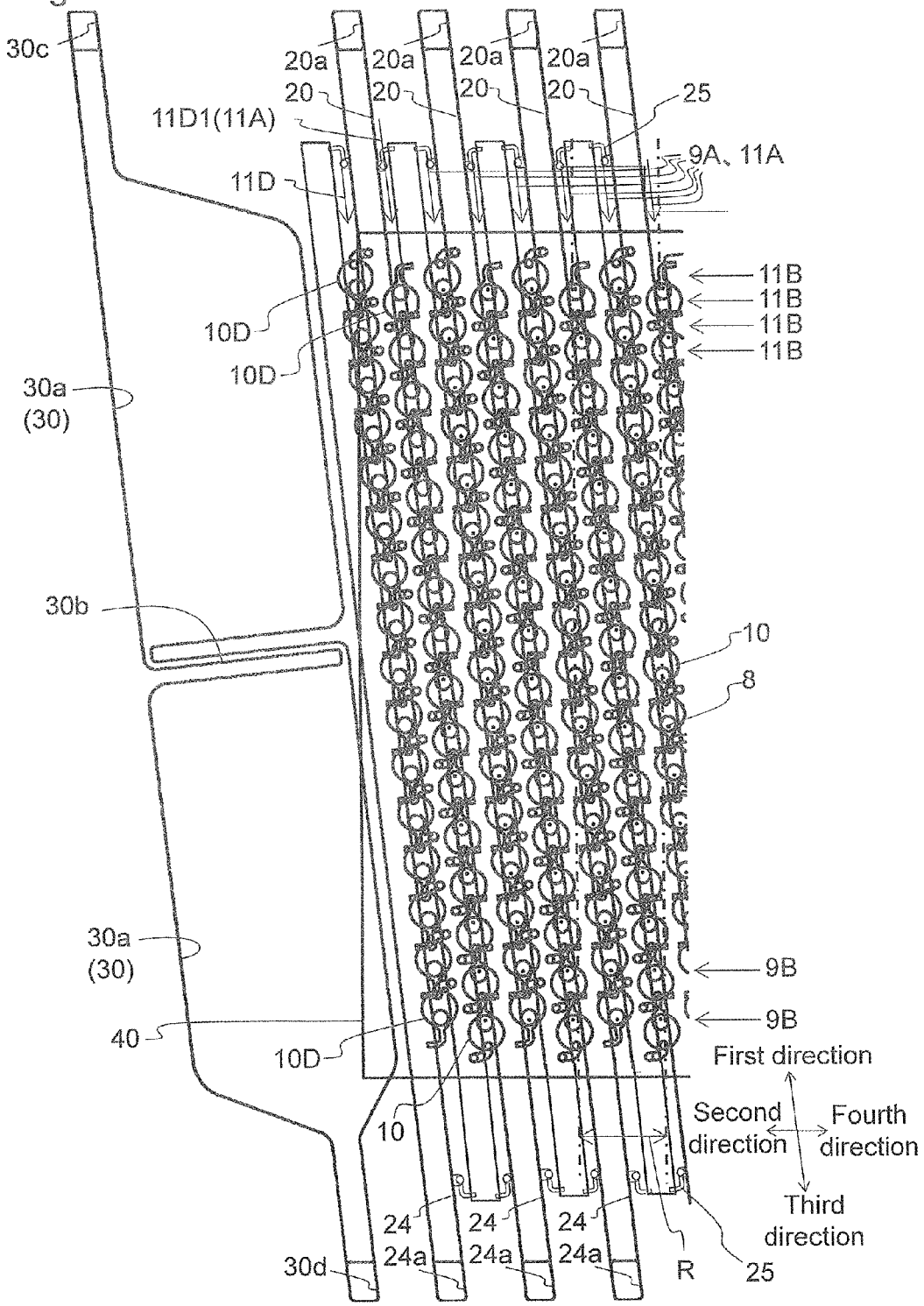
FIG. 3 is a partial enlarged plan view of FIG. 2(*b*).
Figure 4:
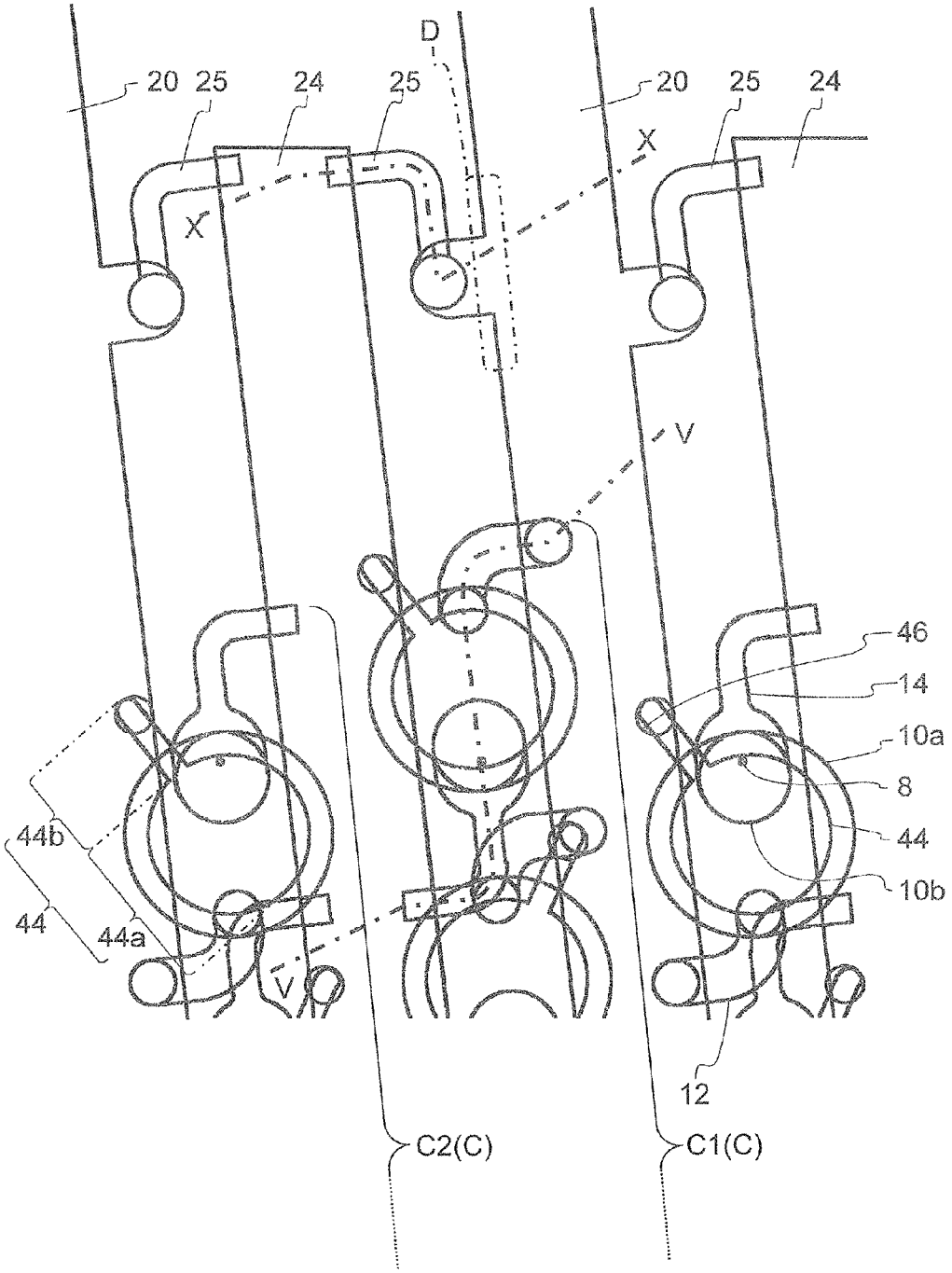
FIG. 4 is a partial enlarged plan view of FIG. 2(*b*).
Figure 5A:
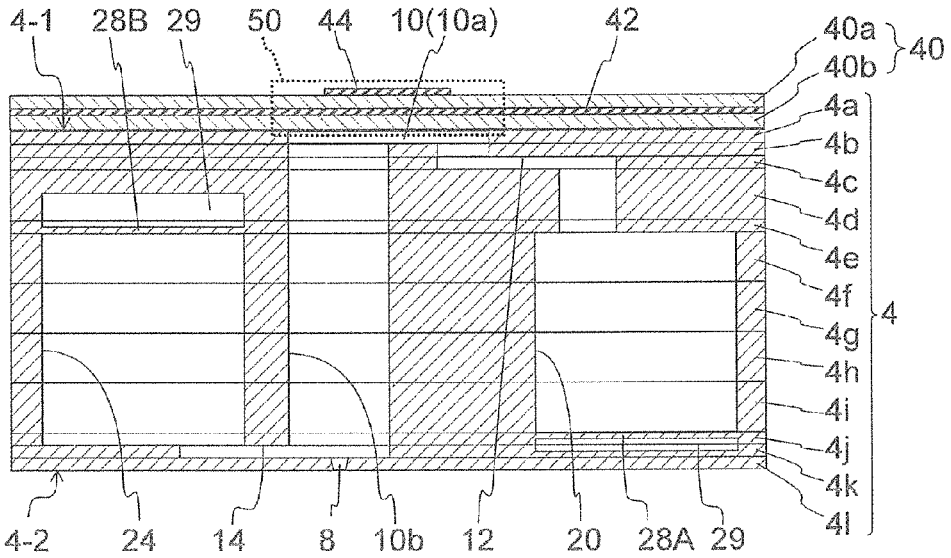
FIG. 5(*a*) is a partial vertical sectional view taken along a line V-V in FIG. 4, and FIG. 5(*b*) is a vertical sectional view of the head body in FIG. 2(*a*).
Figure 5B:
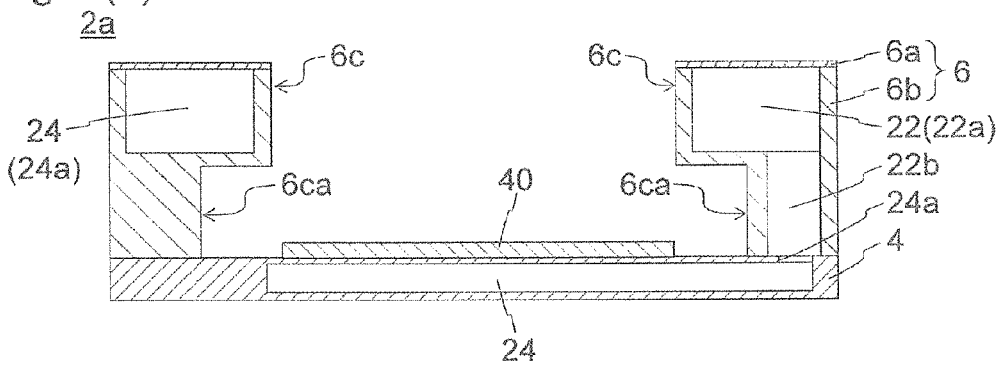
Figure 6:
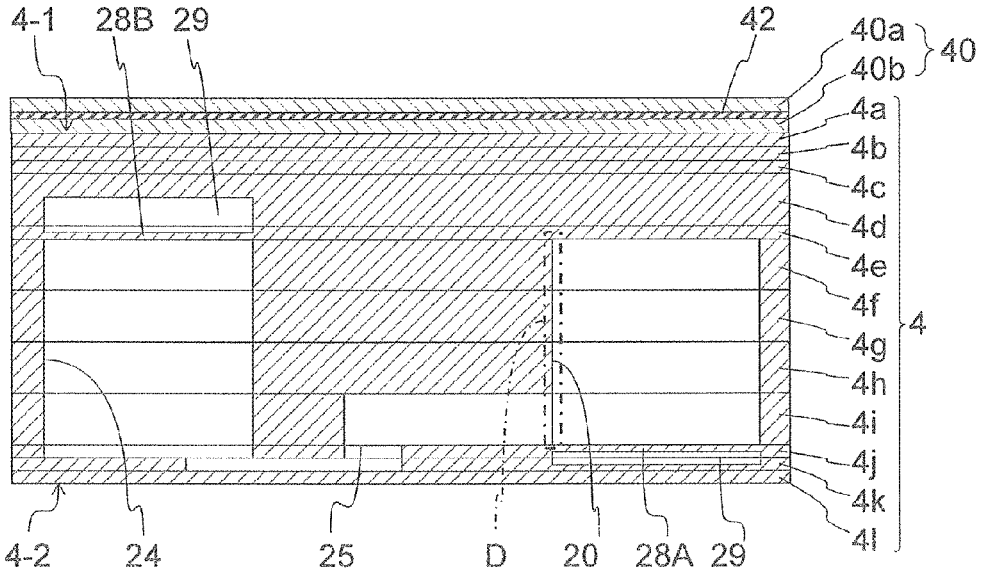
FIG. 6 is a partial vertical sectional view taken along a line X-X in FIG. 4.

Next, the liquid discharge head 2 according to an embodiment of the present disclosure will be described. FIG. 2(*a*) is a plan view of a head body 2*a* that is a main part of the liquid discharge head 2 illustrated in FIG. 1. FIG. 2(*b*) is a plan view of the head body 2*a* without a second flow path member 6. FIG. 3 and FIG. 4 are enlarged plan views of FIG. 2(*b*). FIG. 5(*a*) is a vertical sectional view taken along a line V-V in FIG. 4. FIG. 5(*b*) is a partial vertical sectional view taken along first common flow paths 20 in the vicinity of openings 20*a* in the first common flow paths 20 of the head body 2*a*. FIG. 6 is a partial vertical sectional view taken along a line X-X in FIG. 4.

For simplification, respective drawings are drawn as follows. In FIGS. 2 to 4, flow paths, which are located below other elements and should be drawn by broken lines, are drawn by solid lines. In FIG. 2(*a*), flow paths in a first flow path member 4 are almost omitted, and only arrangement of pressure chambers 10 are illustrated.

The liquid discharge head 2 may include a metal housing, a driver IC, a circuit board in addition to the head body 2*a*. The head body 2*a* includes the first flow path member 4, the second flow path member 6 that supplies liquid to the first flow path member 4, and a piezoelectric actuator board 40 including a displacement element 50 that is a pressure section. The head body 2*a* is a flat plate extending in one direction, and the direction may be referred to as longitudinal direction. The second flow path member 6 serves as a support member, and the head body 2*a* is fixed to the frame 70 at both longitudinal ends of the second flow path member 6.

The first flow path member 4 constituting the head body 2*a* is a flat plate, and its thickness is about 0.5 to 2 mm. Many pressure chambers 10 are aligned in the planar direction on a pressure chamber face 4-1 that is a first principal face of the first flow path member 4. Many discharge holes 8 through which the liquid is discharged are aligned in the planar direction on a discharge hole face 4-2 that is a second principal face of the first flow path member 4 and is opposite to the pressure chamber face 4-1. The discharge holes 8 are linked to the respective pressure chambers 10. Hereinafter, it is assumed that the pressure chamber face 4-1 is located above the discharge hole face 4-2.

The plurality of first common flow paths 20 and the plurality of second common flow paths 24 are arranged in the first flow path member 4 so as to extend in a first direction. The first common flow paths 20 and the second common flow paths 24 are alternately arranged in a second direction that crosses the first direction. The second direction is the same as the longitudinal direction of the head body 2*a*. The direction that is opposite to the first direction is defined as a third direction, and the direction that is opposite to the second direction is defined as a fourth direction.

The pressure chambers 10 are aligned along both sides of the first common flow paths 20 to constitute two pressure chamber lines 11A in total. The first common flow paths 20 and the pressure chambers 10 aligned on both sides of the first common flow paths 20 are linked via first individual flow paths 12.

The pressure chambers 10 are aligned along both sides of the second common flow paths 24 to constitute two pressure chamber lines 11A in total. The second common flow paths 24 and the pressure chambers 10 aligned on both sides of the second common flow paths 24 are linked via second individual flow paths 14. Hereinafter, the first common flow paths 20 and the second common flow paths 24 may be collectively referred to as common flow paths.

In other words, the pressure chambers 10 are aligned on a virtual line, the first common flow paths 20 extend along one side of the virtual line, and the second common flow paths 24 extend along the other side of the virtual line. In this embodiment, the virtual line along which the pressure chambers 10 are aligned is linear and however, may be curved or bent.

The first common flow paths 20 and the second common flow paths 24 are linked via connection flow paths 25 outside a range in which the first common flow paths 20 and the second common flow paths 24 are linked via the pressure chambers in the first direction. In the first direction, the range in which the first common flow paths 20 and the second common flow paths 24 are linked via the pressure chambers 10 is referred to as a connection range C. The connection range C in the first common flow paths 20 is referred to as a first connection range C1, and the connection range C in the second common flow paths 24 is referred to as a second connection range C2 (See FIG. 4).

The first common flow paths 20 are linked to the plurality of pressure chambers 10 at substantially regular intervals in the first connection range C1. Outside the first connection range C1 in the first direction, the first common flow paths 20 each are linked to the adjacent second common flow path 24 in the second direction via one connection flow path 25, and each are linked to the adjacent second common flow path 24 in the fourth direction via one connection flow paths 25. Further, outside the first connection range C1 in the third direction, the first common flow paths 20 each are linked to the adjacent second common flow path 24 in the second direction via one connection flow path 25, and each are linked to the adjacent second common flow path 24 in the fourth direction via one connection flow path 25.

That is, the first common flow paths 20 each are linked to the two connection flow paths 25 outside the first connection range C1 in the first direction, and to the two connection flow paths 25 outside the first connection range C1 in the third direction, that is, to the four connection flow paths 25 in total. Similarly, the second common flow paths 24 each are linked to the two connection flow paths 25 outside the second connection range C2 in the first direction, and to the two connection flow paths 25 outside the second connection range C2 in the third direction, that is, to the four connection flow paths 25 in total.

With such configuration, in the first flow path member 4, liquid supplied to the second common flow paths 24 flows into the pressure chambers 10 aligned along the second common flow paths 24. A portion of the liquid is discharged from the discharge holes 8, while another portion of the liquid flows into the first common flow paths 20 located on the opposite side to second common flow paths 24 across the pressure chambers 10, and is discharged outside the first flow path member 4. Still another portion of liquid do not pass through any pressure chamber 10, and flows from the second common flow paths 24 into the first common flow paths 20 via the connection flow paths 25.

The resistance of the connection flow paths 25 is larger than the resistance of the first common flow paths 20 and the second common flow paths 24. For this reason, liquid passes mainly each of the pressure chambers 10. That is, the proportion of the total quantity of liquid flowing through the connection flow paths 25 in the quantity of liquid flowing through the section having the largest flow rate in the first common flow paths 20 is a half or less. This can reduce the pressure difference in meniscus of the discharge holes 8 (hereinafter also referred to as meniscus pressure difference) .

The second common flow paths 24 are disposed on both sides of the first common flow path 20, and the first common flow paths 20 are disposed on both sides of the second common flow path 24. With this configuration, as compared to the configuration in which one first common flow path 20 and one second common flow path 24 are linked to one pressure chamber line 11A, and another first common flow path 20 and another second common flow path 24 are linked to another pressure chamber line 11A, the number of the first common flow paths 20 and the second common flow paths 24 can be suitably reduced almost by half. Since the number of the first common flow paths 20 and the second common flow paths 24 can be decreased, the number of the pressure chambers 10 can be increased to improve resolution, the first common flow paths 20 and the second common flow paths 24 can be made thicker to reduce a difference in discharge properties of the discharge holes 8, or the dimension of the head body 2*a* in the planar direction can be reduced.

The pressure applied to the first individual flow path 12 linked to the first common flow path 20 on the side of the first common flow path 20 varies depending on the position where the first individual flow path 12 is linked to the first common flow path 20 (mainly, the position in the first direction) due to pressure loss. The pressure applied to the second individual flow path 14 linked to the second common flow path 24 varies depending on the position where the second individual flow path 14 is linked to the second common flow path 24 (mainly, the position in the first direction) due to pressure loss. By locating the openings 20*a* of the first common flow paths 20 at one end in the first direction, and openings 24*a* of the second common flow paths 24 at the other end in the first direction, a pressure difference caused by arrangement of the first individual flow paths 12 and the second individual flow paths 14 can be cancelled to reduce a difference in pressure applied to the discharge holes 8. It is noted that the openings 20*a* of the first common flow paths 20 and the openings 24*a* of the second common flow paths 24 are opened to the pressure chamber face 4-1.

In the non-discharging state, the discharge hole 8 holds meniscus of liquid. In the discharge hole 8, the pressure of the liquid is negative (the liquid is forced to be drawn into the first flow path member 4), and achieves a balance with the surface tension of the liquid to hold meniscus. Since the surface tension of the liquid attempts to reduce the surface area of the liquid, positive pressure if low can hold meniscus. When positive pressure becomes high, the liquid overflows, and when negative pressure becomes high, the liquid is drawn into the first flow path member 4 and cannot be kept in dischargeable state. Therefore, it is need to prevent the meniscus pressure difference from being too high when liquid flows from the second common flow paths 24 to the first common flow paths 20.

A wall face of the first common flow path 20 on the side of the discharge hole face 4-2 constitutes a first damper 28A. One face of the first damper 28A faces the first common flow path 20, and the other face of the first damper 28A faces a damper chamber 29. Due to the presence of the damper chamber 29, the first damper 28A can be deformed to change the volume of the first common flow path 20. When liquid in the pressure chamber 10 is pressed so as to discharge the liquid, a part of the pressure is transmitted to the first common flow path 20 through the liquid. As a result, the liquid in the first common flow path 20 vibrates, the vibration is transmitted to the relevant pressure chamber 10 and other pressure chambers 10, possibly causing a fluid cross talk that changes liquid discharge properties. In the configuration where the first damper 28A is provided, since the first damper 28A attenuates the liquid vibration transmitted to the first common flow path 20, the liquid in the first common flow path 20 hardly continues to vibrate to reduce the effect of the fluid cross talk. The first damper 28A also functions to stabilize feeding/discharge of liquid.

A wall face of the second common flow path 24 on the side of the pressure chamber face 4-1 constitutes a second damper 28B. One face of the second damper 28B faces the second common flow path 24, and the other face of the second damper 28B faces the damper chamber 29. Like the first damper 28A, the second damper 28B can reduce the effect of fluid cross talk. In addition, the second damper 28B also functions to stabilize feeding/discharge of liquid.

The pressure chambers 10 each face the pressure chamber face 4-1, and are a hollow region including a pressure chamber body 10*a* pressed by the displacement element 50, and a descender 10*b*, which is a partial flow path leading to the discharge hole 8 opened on the lower side of the pressure chamber body 10*a* to the discharge hole face 4-2. The pressure chamber body 10*a* is shaped like a right circular cylinder, and is circular in a plan view. Since the pressure chamber body 10*a* is circular in a plan view, the displacement quantity with the same deformation force of the displacement element 50, and a change in volume of the pressure chamber 10 due to displacement can be increased. The descender 10*b* is smaller than the pressure chamber body 10*a* in diameter, is shaped like a right circular cylinder, and has a circular cross section. When viewed from the pressure chamber face 4-1, the descender 10*b* falls within the pressure chamber body 10*a*.

The plurality of pressure chambers 10 are disposed on the pressure chamber face 4-1 in a staggered manner. The plurality of pressure chambers 10 constitute the plurality of pressure chamber lines 11A extending along the first direction. In each of the pressure chamber lines 11A, the pressure chambers 10 are arranged at substantially regular intervals. The pressure chambers 10 belonging to a certain pressure chamber line 11A are shifted from the pressure chambers 10 belonging to the adjacent pressure chamber line 11A by a half of the above interval in the first direction. In other words, the pressure chambers 10 belonging to a certain pressure chamber line 11A are located almost at the center between the two consecutive pressure chambers 10 belonging to the adjacent chamber line 11A.

In this manner, the pressure chambers 10 belonging to the alternate pressure chamber lines 11A are arranged in the second direction to constitute a pressure chamber row 11B.

In this embodiment, the 51 first common flow paths 20, the 50 second common flow paths 24, and the 100 pressure chamber lines 11A are provided. It is noted that dummy pressure chamber lines 11D constituted of only dummy pressure chambers 10D described later are not included in the number of the pressure chamber lines 11A described above. The second common flow paths 24 directly linked to only the dummy pressure chambers 10D are not included in the number of the second common flow paths 24 described above. The pressure chamber lines 11A each have 16 pressure chambers 10. However, the pressure chamber line 11A located at the end in the second direction has eight pressure chambers 10 and eight dummy pressure chambers 10D. Since the pressure chambers 10 are disposed in a staggered manner as described above, the number of the pressure chamber rows 11B is 32.

The plurality of pressure chambers 10 are arranged on the discharge hole face 4-2 in a grid-like manner in the first direction and the second direction. The plurality of discharge holes 8 constitute a plurality of discharge hole lines 9A extending in the first direction. The discharge hole lines 9A and the pressure chamber lines 11A are located at the substantially same positions.

The center of the area of the pressure chamber 10 is shifted from the center of the area of the discharge hole 8 linked to the pressure chamber 10 in the first direction. They are shifted from each other in the same direction in one pressure chamber line 11A, and in the opposite directions in adjacent pressure chamber lines 11A. The discharge holes 8 linked to the pressure chambers 10 belonging to two pressure chamber rows 11B constitute one discharge hole row 9B disposed along the second direction.

Accordingly, in this embodiment, 100 discharge hole lines 9A and 16 discharge hole rows 9B are provided.

The center of the area of the pressure chamber body 10*a* is shifted from the center of the area of the discharge holes 8 linked to the pressure chamber body 10*a* in the first direction. The descender 10*b* is shifted from the pressure chamber body 10*a* toward the discharge hole 8. A side wall of the pressure chamber body 10*a* abuts a side wall of the descender 10*b* to prevent liquid from staying in the pressure chamber body 10*a*.

The discharge hole 8 is located in the central part of the descender 10*b*. The central part refers to a region of a circle having the center of the area of the descender 10*b*, the region being a half of the descender 10*b* in diameter.

A connection portion between the first individual flow path 12 and the pressure chamber body 10*a* is located on the opposite side to the descender 10*b* across the center of the area of the pressure chamber body 10*a*. Thus, liquid flowing from the descender 10*b* spreads over the pressure chamber body 10*a* and then, flows toward the first individual flow path 12, preventing from being stayed in the pressure chamber body 10*a*.

The second individual flow path 14 is drawn from the face of the descender 10*b* on the side of the discharge hole face 4-2 in the planar direction, and is connected to the second common flow path 24. The drawing direction is the same as the direction in which the descender 10*b* is shifted from the pressure chamber body 10*a*.

An angle that the first direction forms with the second direction is deviated from right angle. Thus, the discharge holes 8 belonging to the discharge hole line 9A disposed along the first direction are arranged with the deviated angle in the second direction. Since the discharge hole line 9A is aligned in the second direction, the discharge holes 8 belonging to the different discharge hole lines 9A are arranged with the deviated angle in the second direction. As a result, the discharge holes 8 of the first flow path member 4 are disposed at regular intervals in the second direction, such that a predetermined range can be filled with pixels formed of discharged liquid in printing.

By arranging the discharge holes 8 belonging to one discharge hole line 9A on a straight line in the first direction, printing can be made to fill a predetermined range as described above. However, with such arrangement, any displacement of the direction orthogonal to the second direction from the conveyance direction, which is caused at installation of the liquid discharge heads 2 in the printer 1, greatly affects the printing accuracy. For this reason, rather than the above-mentioned arrangement of the discharge holes 8 on the straight line, it is preferred to displace the discharge holes 8 between the adjacent discharge hole lines 9A.

In this embodiment, the discharge holes 8 are arranged as follows. In FIG. 3, the discharge holes 8 are disposed in the direction that is orthogonal to the second direction, the 32 discharge holes 8 are disposed in a range of a virtual straight line R, and are spaced in the virtual straight line R at intervals of 360 dpi. Thus, the printing sheet P can be conveyed in the direction that is orthogonal to the virtual straight line R, achieving printing with the resolution of 360 dpi. The discharge holes 8 disposed in the virtual straight line R are all of the discharge holes 8 belonging one discharge hole line 9A (16) and half of the discharge holes 8 belonging to the two discharge hole lines 9A on the both side of the one discharge hole lines 9A (8×2). With such configuration, in each discharge hole row 9B, the discharge holes 8 are arranged at intervals of 22.5 dpi (360/16=22.5).

The first common flow paths 20 and the second common flow paths 24 each are arranged in a straight line in the range where the discharge holes 8 are linearly arranged, and are shifted in parallel between the discharge holes 8 in different straight lines. Since the shift is small in the first common flow paths 20 and the second common flow paths 24, the resistance of the flow paths is small. Further, since the parallelly-shifted flow paths do not overlap the pressure chambers 10, a change in discharge properties for each pressure chamber 10 is small.

One (that is, two in total) pressure chamber line 11A on each end in the second direction includes the normal pressure chambers 10 and the first dummy pressure chambers 10D (Thus, the pressure chamber lines 11A may be referred to as dummy pressure chamber lines 11D). One (that is, two in total) dummy pressure chamber line 11D including only the dummy pressure chambers 10D is disposed on the outer side of the dummy pressure chamber line 11D. One (that is, two in total) flow path on each side in the second direction has the same shape as the normal first common flow paths 24 except that the flow path is not directly linked to the pressure chambers 10, and is directly linked to only the dummy pressure chambers 10D.

The first flow path member 4 has an end flow path 30 that is located on the outer side of the common flow path group including the first common flow paths 20 and the second common flow paths 24 in the second direction, and extends in the first direction. The end flow path 30 is a flow path that links an opening 30*c*, which is located on the further outer side of the openings 20*a* of the first common flow paths 20 arranged on the pressure chamber face 4-1, to an opening 30*d*, which is located on the further outer side of the openings 24*a* of the second common flow paths 24 arranged on the pressure chamber face 4-1.

To stabilize discharge properties of liquid, the temperature of the head body 2*a* is controlled to be constant. As the viscosity of liquid is lower, discharge and circulation of the liquid becomes more stabilized. For this reason, temperature is generally set to ordinary temperature or more. Thus, heating is basically performed. However, when the environmental temperature is high, the head body 2*a* may be cooled.

To keep the temperature constant, the liquid discharge head 2 may be provided with a heater, or the temperature of liquid to be fed may be adjusted. Anyway, when there is a difference between environmental temperature and target temperature, more heat is radiated from the end of the head body 2*a* in the longitudinal direction (second direction). Thus, the temperature of the pressure chambers 10 located on both ends in the second direction tends to be lower than the temperature of liquid in the pressure chambers 10 located in the middle in the second direction. Due to the end flow path 30, the temperature of the pressure chambers 10 located on both ends in the second direction hardly decreases, and a variation in discharge properties of liquid to be discharged from the pressure chambers 10 can be reduced to improve printing accuracy.

The end flow path 30 links the first integration flow path 22 to the second integration flow path 26. Preferably, the resistance of the end flow path 30 is set to be smaller than that of the first common flow paths 20 and the second common flow paths 24. In doing so, the quantity of liquid flowing to the end flow path 30 increases, suppressing a decrease in the temperature of the region located inner than the end flow path 30.

The end flow path 30 is provided with a widened portion 30*a* that is wider than the common flow path, and a damper is provided on a pressure chamber side 4-1 of the widened portion 30*a*. One face of the damper faces the widened portion 30*a*, and the other face of the damper faces a damper chamber and can be deformed. The narrowest portion of the deformable region largely affects the damping capability of the damper. Thus, the damper that faces the widened portion

30*a* has a high damping capability. Preferably, the width of the widened portion 30*a* is twice or third times of the width of the common flow path or larger. When the widened portion 30*a* makes the resistance too low, a narrowed portion 30*d* may be provided to adjust the resistance.

The second flow path member 6 is bonded to the pressure chamber face 4-1 of the first flow path member 4. The second flow path member 6 has a second integration flow path 26 that supplies liquid to the second common flow paths 24, and a first integration flow path 22 that collects liquid in the first common flow paths 20. The thickness of the second flow path member 6 is larger than that of the first flow path member 4, and is about 5 to 30 mm.

The second flow path member 6 is bonded to the region of the first flow path member 4, in which the piezoelectric actuator board of the pressure chamber face 4-1 is not connected. More specifically, second flow path member 6 is bonded so as to surround the piezoelectric actuator board 40. This can prevent a part of discharged liquid in the form of mist from adhering to the piezoelectric actuator board 40. Further, since the first flow path member 4 is fastened on its outer circumference, the first flow path member 4 can be suppressed from vibrating due to driving of the displacement elements 50 to cause resonance.

A through hole 6*c* vertically penetrates the center of the second flow path member 6. A wiring member such as an FPC (Flexible Printed Circuit) that transmits a driving signal to drive the piezoelectric actuator board 40 passes through the through hole 6*c*. The through hole 6*c* has an extended portion 6*ca* extended in the transverse direction on the side of the first flow path member 4. The wiring member extending from the piezoelectric actuator board 40 to both sides in the transverse direction is bent at the extended portion 6*ca*, runs upward and then, escapes from the through hole 6*c*. It is noted that a convex portion of the extended portion 6*ca* can damage the wiring member and, is preferably made R-shaped.

By disposing the first integration flow path 22 in the second flow path member 6 that is thicker than the first flow path member 4 and is separate from the first flow path member 4, the sectional area of the first integration flow path 22 can be increased to reduce a difference in pressure loss caused by a difference in position where the first integration flow path 22 is linked to the first common flow paths 20. Preferably, the resistance of the first integration flow path 22 (more accurately, the resistance of the region of the first integration flow path 22, which is linked to the first common flow paths 20) is 1/100 of the resistance of the first common flow paths 20 or less.

By disposing the second integration flow path 26 in the second flow path member 6 that is thicker than the first flow path member 4 and is separate from the first flow path member 4, the sectional area of the second integration flow path 26 can be increased to reduce a difference in pressure loss caused by a difference in position where the second integration flow path 26 is linked to the second common flow paths 24. Preferably, the resistance of the second integration flow path 26 (more accurately, the resistance of the region of the second integration flow path 26, which is linked to the first integration flow path 22) is 1/100 of the resistance of the second common flow paths 24 or less.

The first integration flow path 22 is disposed on one transverse end of the second flow path member 6, the second integration flow path 26 is disposed on the other transverse end of the second flow path member 6, and the flow paths are directed to the first flow path member 4 and linked to the first common flow paths 20 and the second common flow paths 24, respectively. With such configuration, the sectional area of the first integration flow path 22 and the second integration flow path 26 can be increased (that is, the resistance can be reduced). Further, the second flow path member 6 can fasten the outer circumference of the first flow path member 4 to increase rigidity, and include the through hole 6*c* through which the wiring member passes.

The second flow path member 6 is configured by laminating plates 6*a*, 6*b* of the second flow path member. An upper face of the plate 6*b* has a groove that is a first integration flow path body 22*a* of the first integration flow path 22, which extends in the second direction and has a low resistance, and a groove that is a second integration flow path body 26*a* of the second integration flow path 26, which extends in the second direction and has a low resistance.

The lower side (near the first flow path member 4) of the groove as the first integration flow path body 22*a* is mostly covered with the pressure chamber face 4-1, and is partially linked to the openings 20*a* of the first common flow paths 20 opened on the pressure chamber face 4-1.

The lower side of the groove as the second integration flow path body 26*a* is mostly covered with the pressure chamber face 4-1, and is partially linked to the openings 24*a* of the second common flow paths 24 opened on the pressure chamber face 4-1.

The plate 6*a* is provided with an opening 22*c* at an end of the first integration flow path 22 in the second direction. The plate 6*a* is provided with an opening 26*c* at an end of the second integration flow path 26 in the fourth direction that is opposite to the second direction. Liquid is fed through the opening 26*c* of the second integration flow path 26, and collected through the opening 22*c* of the first integration flow path 22. This feeding and collection may be reversed.

The first integration flow path 22 and the second integration flow path 26 each may be provided with a damper to stabilize feeding or discharging of liquid in response to a variation in the quantity of discharged liquid. The first integration flow path 22 and the second integration flow path 26 each may be provided with a filter to prevent foreign objects and bubbles from entering into the first flow path member 4.

The piezoelectric actuator board 40 including the displacement elements 50 is bonded to the pressure chamber face 4-1 that is the upper face of the first flow path member 4 such that each displacement element 50 is located above the pressure chamber 10. The piezoelectric actuator board 40 occupies the almost same shaped area as the group of pressure chambers consisting of the pressure chambers 10. The openings of the pressure chambers 10 are covered by bonding the piezoelectric actuator board 40 to the pressure chamber face 4-1 of the flow path member 4. The piezoelectric actuator board 40 is a rectangle extending in the same direction as the head body 2*a*. A signal transmission unit such as FPC for transmitting a signal to each displacement element 50 is connected to the piezoelectric actuator board 40. The second flow path member 6 has the through hole 6*c* vertically passing therethrough at the center thereof, and the signal transmission unit is electrically connected to the control unit 88 via the through hole 6*c*. Preferably, the signal transmission unit extends in the transverse direction from one end to the other end of the long side of the piezoelectric actuator board 40 such that wires in the signal transmission unit runs in the transverse direction and are aligned in the longitudinal direction. With such arrangement, advantageously, the sufficient distance between the wires can be ensured.

Individual electrodes 44 are disposed on the upper face of the piezoelectric actuator board 40 to be opposed to the respective pressure chambers 10.

The flow path member 4 is configured by laminating a plurality of plates. From the pressure chamber face 4-1 of the flow path member 4, 12 plates of a plate 4*a* to a plate 4*l* are laminated in this order. The plates have a lot of holes or grooves. For example, the holes or grooves can be formed by etching a metal plate. Since the thickness of each plate is about 10 to 300 μm, the accuracy of forming the holes or grooves can be increased. The plates are positioned and laminated such that the holes or grooves communicate with each other to constitute the first common flow path 20 and so on.

The pressure chamber bodies 10*a* are opened to the pressure chamber face 4-1 of the flat flow path member 4 and the piezoelectric actuator board 40 is bonded to the pressure chamber face 4-1. Further, the openings 24*a* for feeding liquid to the second common flow paths 24, and the openings 20*a* for collecting liquid from the first common flow paths 20 are opened on the pressure chamber face 4-1. The discharge holes 8 are opened on the discharge hole face 4-2 of the flow path member 4, which is opposite to the pressure chamber face 4-1. Another plate may be laminated on the pressure chamber face 4-1 to cover the openings of the pressure chamber bodies 10*a*, and the piezoelectric actuator board 40 may be bonded thereto. In doing so, the possibility that discharged liquid contacts the piezoelectric actuator board 40 can be lowered to improve reliability.

The structure for discharging liquid includes the pressure chambers 10 and the discharge holes 8. The pressure chambers 10 each are configured of the pressure chamber body 10*a* that faces the displacement element 50, and the descender 10*b* having a smaller sectional area than the pressure chamber body 10*a*. The pressure chamber body 10*a* is formed on the plate 4*a*, and the descender 10*b* is configured by stacking holes formed in the plates 4*b* to 4*k*, and covering the holes (except for the discharge holes 8) with the nozzle plate 4*l*.

The pressure chamber body 10*a* is linked to the first individual flow path 12, and the first individual flow path 12 is linked to the first common flow paths 20. Each first individual flow path 12 includes a circular hole penetrating the plate 4*b*, a through groove extending in the plate 4*c* in the planar direction, and a circular hole penetrating the plate 4*d*. The first common flow path 20 is configured by stacking holes formed in the plates 4*f* to 4*i*, and covering the upper side of the holes with the plate 4*e* and the lower side of the holes with the plate 4*j*.

The descender 10*b* is linked to the second individual flow path 14, and the second individual flow path 14 is linked to the second common flow paths 24. The second individual flow path 14 is a through groove extending in the plate 4*j* in the planar direction. The second common flow path 24 is configured by stacking holes formed in the plates 4*f* to 4*i*, and covering the upper side of the holes with the plate 4*e* and the lower side of the holes with the plate 4*j*.

Describing the flow of liquid in summary, liquid fed to the second integration flow path 26 passes the second common flow paths 24 and the second individual flow paths 14 in this order, enters into the pressure chambers 10, and is partially discharged through the discharge holes 8. The undischarged liquid passes the first individual flow paths 12, enters into the first common flow paths 20, and then, into the first integration flow path 22, and is discharged to the outside of the head body 2.

The piezoelectric actuator board 40 has a laminated structure including two piezoelectric ceramic layers 40*a*, 40*b* as piezoelectric substances. The piezoelectric ceramic layer 40*a*, 40*b* each has a thickness of about 20 μm. That is, the thickness of the piezoelectric actuator board 40 from an upper face of the piezoelectric ceramic layer 40*a* to a lower face of the piezoelectric ceramic layer 40*b* is about 40 μm. The ratio of the piezoelectric ceramic layer 40*a* to the piezoelectric ceramic layer 40*b* in thickness is set to 3:7 to 7:3, preferably, 4:6 to 6:4. Any of the piezoelectric ceramic layers 40*a*, 40*b* extends over the plurality of pressure chambers 10. The piezoelectric ceramic layers 40*a*, 40*b* are made of ceramic materials having ferroelectricity, such as lead zirconate titanate (PZT)-type, $NaNbO_3$-type, $BaTiO_3$-type, $(BiNa)NbO_3$-type, and $BiNaNb_5O_{15}$-type materials.

The piezoelectric actuator board 40 has a common electrode 42 made of a metal material such as Ag—Pd-type materials, and individual electrodes 44 made of a metal material such as Au-type materials. The thickness of the common electrode 42 is about 2 μm, and the thickness of the individual electrode 44 is about 1 μm.

The individual electrodes 44 are arranged on the upper face of the piezoelectric actuator board 40 to be opposed to the respective pressure chambers 10. Each individual electrode 44 includes an individual electrode body 44*a* that is smaller than the pressure chamber body 10*a* and has the substantially same shape as the pressure chamber body 10*a* in a plan view, and a drawn electrode 44*b* drawn from the individual electrode body 44*a*. A connection electrode 46 is formed at one end of the drawn electrode 44*b*, which is drawn to the outside of the area opposed to the pressure chamber 10. The connection electrode 46 is made of conductive resin containing conductive particles such as silver particles, and has a thickness of 5 to 200 μm. The connection electrode 46 is electrically connected to an electrode provided in the signal transmission unit.

A surface electrode for common electrode (not illustrated) is formed on the upper face of the piezoelectric actuator board 40. The surface electrode for common electrode is electrically connected to the common electrode 42 via a through conductor (not illustrated) disposed on the piezoelectric ceramic layer 40*a*.

As described later in detail, a driving signal is transmitted from the control unit 88 to the individual electrodes 44 through the signal transmission unit. The driving signal is fed at a certain cycle in sync with the conveyance speed of the printing medium P.

The common electrode 42 is formed in the substantially entire area between the piezoelectric ceramic layer 40*a* and the piezoelectric ceramic layer 40*b* in the planar direction. That is, the common electrode 42 covers all pressure chambers 10 in the area opposed to the piezoelectric actuator board 40. The common electrode 42 is connected to the surface electrode for common electrode, which is formed on the piezoelectric ceramic layer 40*a* so as to avoid the group of individual electrodes 44, through a via hole penetratingly formed in the piezoelectric ceramic layer 40*a*, and is grounded and held at the ground potential. Like the plurality of individual electrodes 44, the surface electrode for common electrode is directly or indirectly connected to the control unit 88.

The portion of the piezoelectric ceramic layer 40*a* between the individual electrode 44 and the common electrode 42 is the unimorph-type displacement element 50 that is polarized in the thickness direction, and deformed when a voltage is applied to the individual electrode 44. More specifically, when the individual electrode 44 and the common electrode 42 are set at different potentials and an electric field is applied to the piezoelectric ceramic layer 40*a* in the polarizing direction, the applied portion serves as an activating portion deformed by the piezoelectric effect. With this structure, when the control unit 88 sets the individual electrode 44 to a predetermined positive or negative potential with respect to the common electrode 42 such that the electric field and polarization are the same direction, the portion (activating portion) sandwiched between the electrodes of the piezoelectric ceramic layer 40*a* contracts in the planar direction. On the contrary, the deactivating piezoelectric ceramic layer 40*b* is not affected by the electric field and thus, does not spontaneously contract, attempting to restrict the deformation of the activating portion. As a result, a difference in deformation in the polarizing direction between the piezoelectric ceramic layer 40*a* and the piezoelectric ceramic layer 40*b* occurs, such that the piezoelectric ceramic layer 40*b* deforms (unimorph-deforms) to protrude toward the pressure chamber 10.

Next, the liquid discharge operation will be described. The control unit 88 controls a driver IC and so on to transmit the driving signal to the individual electrode 44, thereby driving (deforming) the displacement elements 50. In this embodiment, liquid can be discharged using various driving signals. Here, a so-called pull driving method is described.

The individual electrode 44 is previously set at a higher potential than the common electrode 42 (hereinafter referred to high potential). At each ejection request, the individual electrode 44 is set at the same potential as the common electrode 42 (hereinafter referred to low potential) once, and then sets at the high potential again at a predetermined timing. Thereby, at the timing when the individual electrode 44 becomes the low potential, the piezoelectric ceramic layers 40*a*, 40*b* (starts to) return to the original (flat) shape, and the volume of the pressure chambers 10 increases from the initial state (the state where both electrodes have different potentials). This applies a negative pressure to liquid in the pressure chamber 10. Then, the liquid in the pressure chamber 10 starts to vibrate at a natural vibration cycle. Specifically, at first, the volume of the pressure chamber 10 starts to increase, and the negative pressure gradually becomes smaller. Subsequently, the volume of the pressure chamber 10 becomes maximum, and the pressure becomes almost zero. Subsequently, the volume of the pressure chamber 10 starts to decrease, and the pressure becomes higher. Then, at the timing when the pressure becomes almost maximum, the individual electrode 44 is set at the high potential. Then, the vibration applied first and the vibration applied next are combined, and a larger pressure is exerted on the liquid. The pressure propagates in the descender, discharging the liquid though the discharge hole 8.

That is, using the high potential as a reference, a pulse driving signal to set the low potential for a certain time can be transmitted to the individual electrode 44, thereby discharging droplets. When the pulse duration is set to AL (Acoustic Length) that is a half of the natural vibration cycle of the liquid in the pressure chamber 10, the discharge rate and discharge quantity of the liquid can be theoretically maximized. The natural vibration cycle of the liquid in the pressure chamber 10 is mainly affected by physical properties of the liquid and the shape of the pressure chamber 10, and also affected by physical properties of the piezoelectric actuator board and properties of the flow path connected to the pressure chamber 10.

Figure 7:
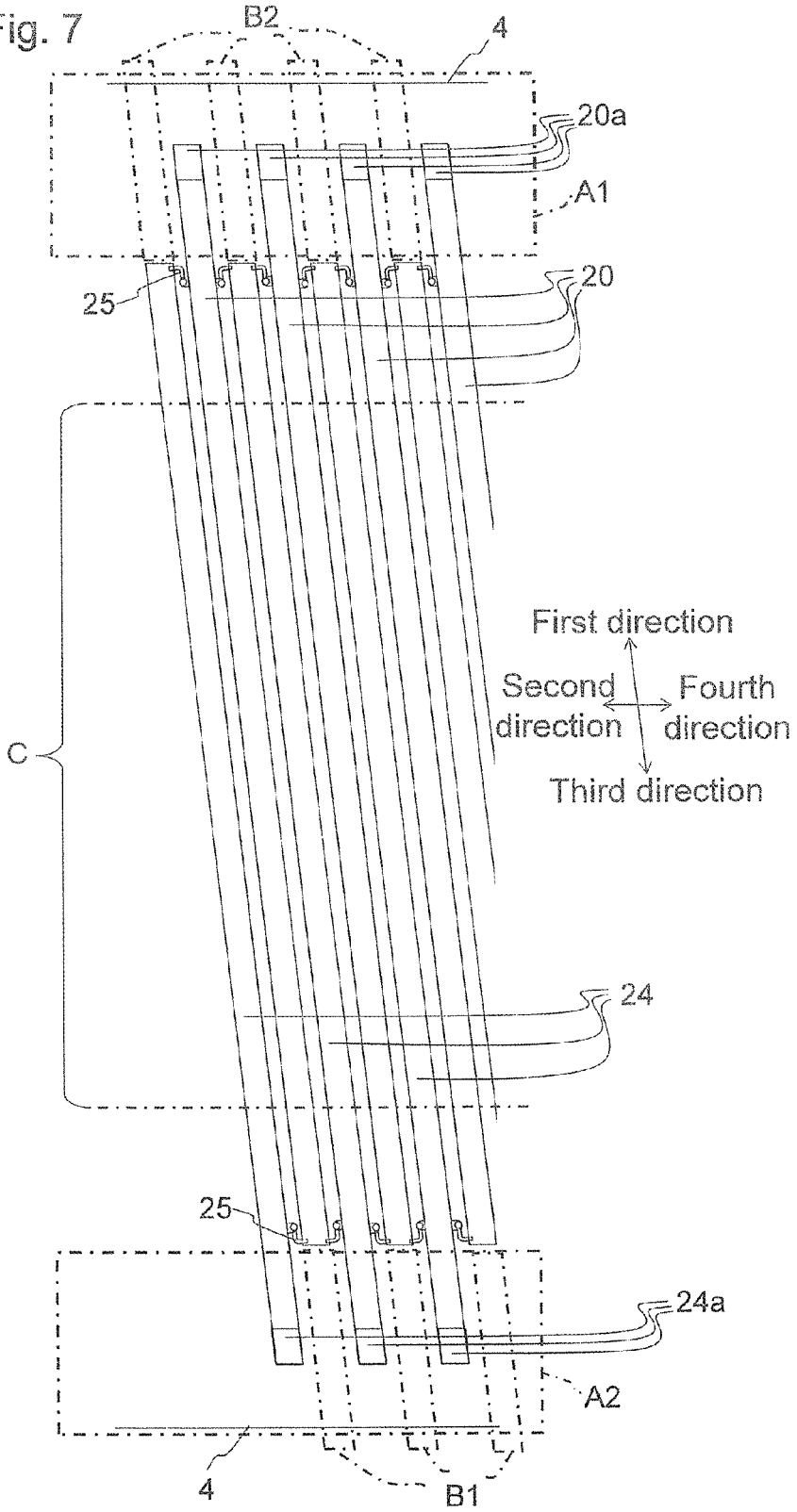
FIG. 7 is an enlarged plan view of common flow paths and bonding areas in a head body.

The first common flow paths 20, the second common flow paths 24, and the connection flow paths 25 will be described below with reference to FIG. 7. The connection range C illustrated in FIG. 7 is schematic. As illustrated in FIG. 5, the first connection range C1 that is connection range C in the first common flow path 20 is slightly displaced from the second connection range C2 that is the connection range C in the second common flow path 24 in the first direction. The first connection range C1 is a range of the first common flow path 20 from the last linked first individual flow path 12 in the first direction to the last linked first individual flow path 12 in the third direction. The second connection range C2 is a range of the first common flow paths 24 from the last linked second individual flow path 14 in the first direction to the last linked second individual flow path 14 in the third direction.

The first common flow path 20 extending in the first direction is linked to the pressure chambers 10 via the first individual flow paths 12 in the middle of the connection range C in the first direction. The first common flow path 20 also extends in the first direction outside the connection range C, and is opened as the opening 20*a* at the end of the first flow path member 4 in the first direction.

The second common flow path 24 extending in the first direction is linked to the pressure chambers 10 via the second individual flow paths 14 in the middle of the connection range C in the first direction. The second common flow paths 24 also extends in the third direction outside the connection range C in the third direction (opposite to the first direction), and is opened as the opening 24*a* at the end of the first flow path member 4 in the third direction.

The first flow path member 4 is bonded to the second flow path member 6 in a first bonding area A1 extending in the second direction at the end of the first flow path member 4 in the first direction, and in a second bonding area A2 extending in the second direction at the end of the first flow path member 4 in the third direction. The first flow path member 4 is also bonded to the second flow path member 6 at the end in the second direction and at the end of the fourth direction.

The opening 20*a* of the first common flow paths 20 is disposed in the first bonding area A1, and is linked to the first integration flow path 22 of the second flow path member 6. The opening 24*a* of the second common flow paths 24 is disposed in the second bonding area A2, and is linked to the second integration flow path 26 of the second flow path member 6.

The first common flow path 20 also extends in the third direction outside the connection range C in the third direction and however, do not reach the second bonding area A2. Then, the first common flow path 20 is linked to the second common flow path 24 via the connection flow path 25 outside the connection range C in the third direction.

Without the connection flow path 25, liquid through only one pressure chamber 10 (two in the configuration where the pressure chambers 10 are arranged in a grid-like manner rather than staggered manner) would flows at the end of the first common flow paths 20 in the connection range C in the third direction. Since one first common flow path 20 is linked to 32 pressure chambers 10, only about 1/32 of the highest flow-rate flows at the end of the connection flow path 25. When the flow rate is low, settlement of solid contents and build-up of bubbles often occur, degrading the liquid circulation state. Providing the connection flow path 25 (such connection flow path 25 may be also referred to as second connection flow path) at the end of the first common flow path 20 in the connection range C in the first direction can increase the flow rate of liquid at the end of the first common flow path 20 in the connection range C in the third direction to improve circulation stability. The connection flow path 25 may be linked to any portion of the second common flow path 24. However, to decrease a meniscus pressure difference, the connection flow path 25 is preferably linked to the second common flow path 24 outside the connection range C in the third direction.

Similarly, providing the connection flow path 25 (such connection flow path 25 may be also referred to as first connection flow path) at the end of the second common flow path 24 in the connection range C in the first direction can improve circulation stability. The connection flow path 25 may be linked to any portion of the first common flow path 20. However, to decrease a meniscus pressure difference, the connection flow path 25 is preferably linked to the first common flow path 20 outside the connection range C in the first direction.

The quantity of liquid flowing in the connection flow path 25 that links one first common flow path 20 to one second common flow path 24 at one end is almost equal to the quantity of liquid flowing in one pressure chamber 10. When two or more connection flow paths 25 are provided there, the total quantity of liquid flowing in the connection flow paths 25 is almost equal to the quantity of liquid flowing in one pressure chamber 10. Specifically, the (total) quantity of liquid flowing in the connection flow path(s) 25 is ½ to twice of the quantity of liquid flowing in one pressure chamber 10. To achieve this, the (total) resistance of the connection flow path(s) 25 is set to almost equal to, specifically, ½ to twice of the resistance of the individual flow paths (whole of the first individual flow paths 12, the pressure chambers 10, and the second individual flow paths).

The first connection flow path and/or the second connection flow path may be provided. Providing the connection flow path 25 increases the meniscus pressure difference. In consideration of this, the connection flow path 25 may be provided on only one side to decrease the meniscus pressure difference. The connection flow path 25 located on the upstream side has a larger effect on the meniscus pressure difference which occurs in providing the connection flow path 25. Thus, if located on one side, the connection flow path 25 is preferably disposed only on the downstream side. If located on both sides, it is preferred that the resistance of the upstream connection flow path 25 is larger than that of the downstream connection flow path 25. The upstream side refers to the side near the opening 24*a* of the second common flow path 24 (third direction) into which liquid in the second common flow path 24 is fed, in the head body 2*a* for circulating liquid from the second common flow path 24 to the first common flow paths 20.

As described above, the second common flow path 24 has an end before reaching the first bonding area A1. Thus, the first flow path member 4 becomes solid in the region where a second extended area B2 extended from the second common flow path 24 in the first direction and the first bonding area A1 overlap each other. This enhances bonding in the first bonding area A1 to improve the rigidity of the first flow path member 4. Similarly, the first flow path member 4 becomes solid in the region where a first extended area B1 extended from the first common flow paths 20 in the third direction and the second bonding area A2 overlap each other. This enhances bonding in the second bonding area A2 to improve the rigidity of the first flow path member 4.

To form the connection flow paths 25 in the first flow path member 4 configured by laminating plates, the plates 4*f* to 4*i* that constitute the first common flow paths 20 and the second common flow paths 24 having holes or grooves may be perforated. However, a part of the plate is not linked to surrounding plates. The plate can be linked to surrounding plates by using half-etched grooves. In this case, portions that prevent plate separation (a part of groove) remains left as support pieces in the first common flow paths 20 and the second common flow paths 24. Disadvantageously, such portions disturb circulation and contribute to settlement of solid contents and build-up of bubbles.

Thus, a part of the some connection flow path 25 may be configured to include holes and/or grooves in the plates 4*a* to 4*d*, which are located above a group of plates 4*f* to 4*i* (such plates may be also referred to as common flow path plates) having holes or grooves constituting the first common flow paths 20 and the second common flow paths 24, or in the plates 4*j*, 4*k* located below the group of the common flow path plates 4*f* to 4*i*. In this manner, the connection flow paths 25 are not configured of only holes or grooves in the common flow path plates 4*f* to 4*i*.

In other words, the first flow path member 4 may include following first plates 4*i*, 4*j* and second plate 4*k*. The first plates 4*i*, 4*j* include holes and/or grooves constituting the connection flow paths 25, and holes and/or grooves constituting the first common flow paths 20 and the second common flow paths 24. The second plate 4*k* includes holes and/or grooves constituting the connection flow paths 25, and no holes and/or grooves constituting the first common flow paths 20 and the second common flow paths 24.

In this manner, even when support pieces are not disposed at least in the vicinity of the connection flow paths 25, in the first common flow paths 20 and the second common flow paths 24, the connection flow paths 25 can be configured. Thus, the liquid discharge head 2 using the first flow path member 4 configured by laminating the plates can stabilize liquid circulation.

Specifically, the connection flow paths 25 each are configured as follows (See FIG. 4 and FIG. 6). One plate 4*i* that constitutes the first common flow path 20 has a portion extended from a side wall in the direction that crosses the first direction. The plate 4*j* laminated under the plate 4*i* has a circular hole linked to the extended portion. The plate 4*k* laminated under the plate 4*j* has an oblong hole communicating with the hole of the plate 4*j*. The hole of the plate 4*k* communicates with the hole of the plate 4*j*, and extends in the first direction. The width and length of the hole can be adjusted to adjust the resistance of the connection flow paths 25. Then, the hole of the plate 4*k* is bent toward the second common flow path 24, and is linked to the lower face of the second common flow path 24.

When the connection flow paths 25 are disposed below the common flow path plates 4*f* to 4*i*, the plate in which the first common flow paths 20 are extended to the connection flow paths 25 is preferably, only the lowest common flow path plates 4*i* among the common flow path plates 4*f* to 4*i*. In this case, the number of the plates constituting the connection flow paths 25 can be reduced to reduce a variation in resistance of the connection flow paths 25 due to deviated lamination. In addition, the number of plates perforated to constitute the connection flow paths 25 can be reduced to preferably improve the rigidity of the first flow path member 4.

By linking the first common flow path 20 to the connection flow path 25 on the side wall D of the first common flow path 20, which extends in the first direction and the plate laminating direction (See FIG. 4 and FIG. 6), the end of the first common flow path 20 in the third direction can be disposed near the second bonding area A2 while making the area under the second bonding area A2 solid. In addition, with such configuration, since the connection flow path 25 need not be linked to the lower face of the first common flow path 20, the first damper 28A can be continuously provided to the outside of the pressure chamber connection area C. This can effectively attenuate vibration of liquid in the first common flow path 20, reducing crosstalk via the liquid.

By linking the second common flow path 24 to the connection flow path 25 on the side wall of the second common flow path 24 along the first direction, the end of the second common flow paths 24 in the first direction can be disposed near the first bonding area A1 while making the area under the first bonding area A1 solid.

Figure 8:
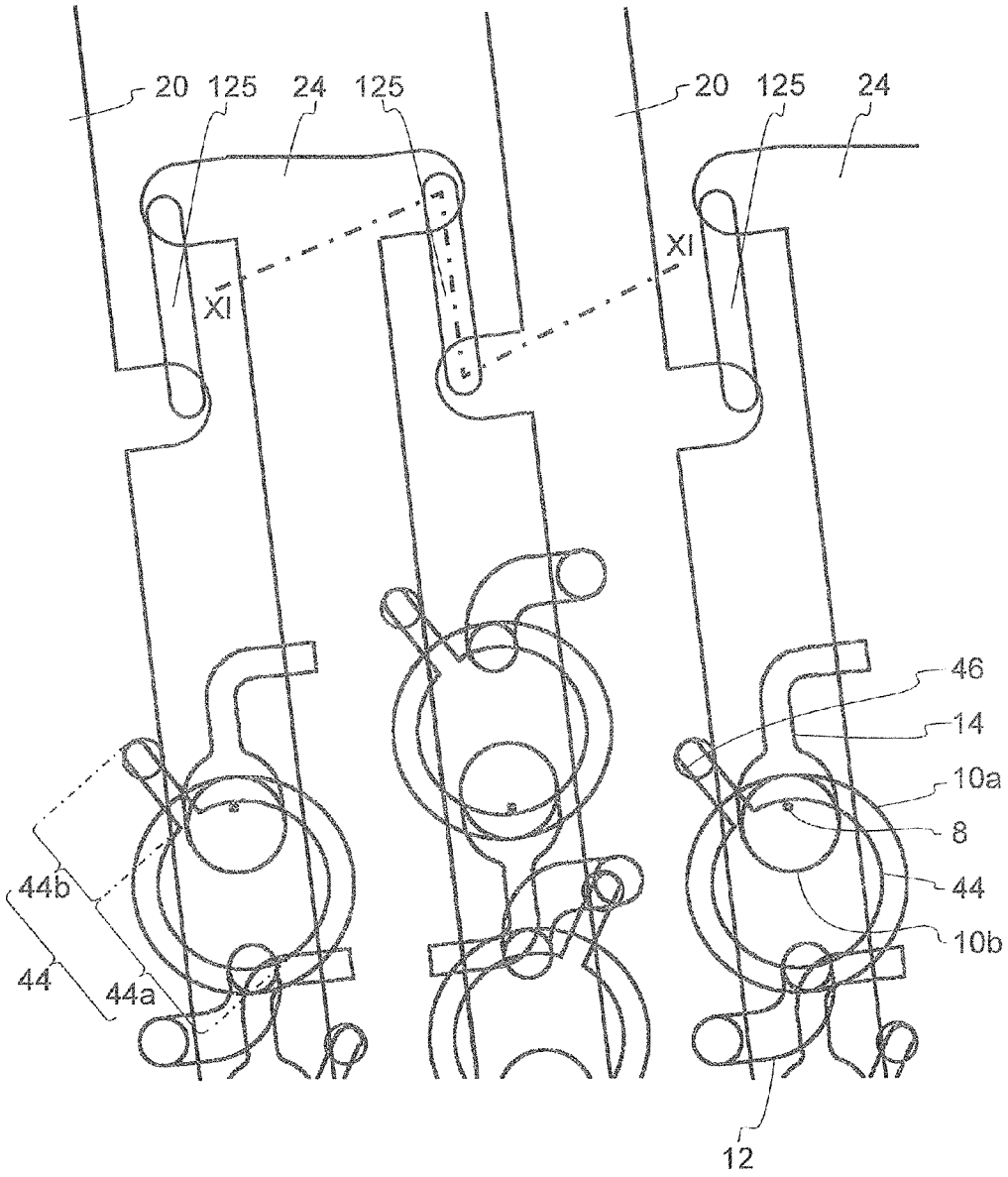
FIG. 8 is an enlarged plan view of a head body according to another embodiment of the present disclosure.

A liquid discharge head 2 according to another embodiment of the present disclosure will be described below with reference to FIGS. 8 and 9. The basic configuration of the liquid discharge head 2 is the same as that of the liquid discharge head 2 illustrated in FIGS. 2 to 5. FIG. 8 is a plan view of the same section in FIG. 4, and FIG. 9 is a vertical sectional view of the same section in FIG. 5.

The second common flow path 24 is linked to the adjacent first common flow path 20 via a connection flow path 125 outside the pressure chamber connection range C in the third direction. Although not illustrated, the first common flow path 20 is linked to the adjacent second common flow path 24 via the connection flow path 125 outside the pressure chamber connection range C in the first direction.

Figure 9:
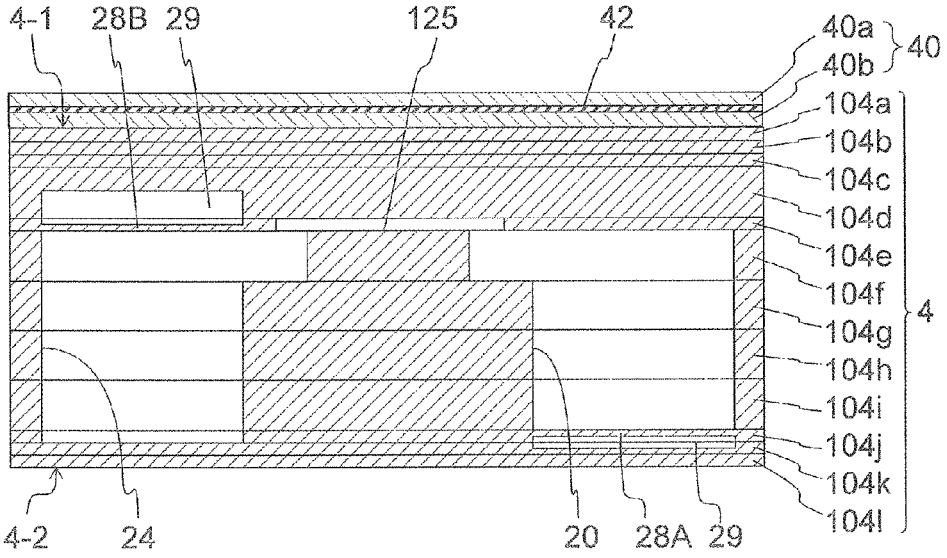
FIG. 9 is a partial vertical sectional view taken along a line XI-XI in FIG. 8.

As illustrated in FIG. 9, the connection flow paths 125 are located above the group of common flow path plates 4*f* to 4*i* including holes and/or grooves that constitute the first common flow paths 20 and the second common flow paths 24. The first flow path member 4 includes the first plate 104*f* including holes and/or grooves that constitute the connection flow paths 125, and holes and/or grooves that constitute the first common flow paths 20 and the second common flow paths 24. The first flow path member 4 includes a second plate 104*e* including holes and/or grooves that constitute the connection flow paths 125, and no holes and/or grooves that constitute the first common flow paths 20 and the second common flow paths 24. Although not illustrated in FIG. 7, the first flow path member 4 includes a third plate 104*a* including holes and/or grooves that constitute the pressure chambers 10. The second plate 104*e* is located on the third plate 104*a* side with respect to the first plate 104*f*.

With the configuration illustrated in FIG. 9, one plate 104*f* among the plates constituting the first common flow paths 20 has a portion extended from a side wall in the direction that crosses the first direction. One plate 104*f* among the plates constituting the second common flow paths 24 has a portion extended from a side wall in the direction that crosses the first direction. The plate 104*e* laminated on the plate 104*f* has an oblong hole that links the above-mentioned extended portions to each other. The hole of the plate 104*e* extends in the first direction. The width and length of the extended hole can be adjusted to adjust the resistance of the connection flow paths 125.

When the connection flow path 125 is disposed above the common flow path plates 104*f* to 104*i*, the plate in which the first common flow path 20 is extended to the connection flow path 125 is preferably, only the highest common flow path plates 104*f* among the common flow path plates 104*f* to 104*i*. In this case, the number of the plates constituting the connection flow paths 125 can be reduced to reduce a variation in resistance of the connection flow paths 125 due to deviated lamination. In addition, the number of plates perforated to constitute the connection flow paths 125 can be reduced to preferably improve the rigidity of the first flow path member 4.

DESCRIPTION OF THE REFERENCE NUMERALS

1: Color ink jet printer
2: Liquid discharge head
2*a*: Head body
4: First flow path member (flow path member)
4*a* to 4*l*, 104*a* to 104*l*: Plate (of first flow path member)
4*f* to 4*i*, 104*f* to 104*i*: Common flow path plate
4*a*, 104*a*: Third plate
4*k*, 104*f*: Second plate
4*i*, 4*j*, 104*e*: First plate
4-1: Pressure chamber face
4-2: Discharge hole face
6: Second flow path member
6*a*, 6*b*: Plate (of second flow path member)
6*c*: Though hole (of second flow path member)
6*ca*: Extended portion of through hole
8: Discharge hole
9A: Discharge hole line
9B: Discharge hole row
10: Pressure chamber
10*a*: Pressure chamber body
10*b*: Partial flow path (Descender)
10D: Dummy pressure chamber
11A: Pressure chamber row
11B: Pressure chamber line
11C: Pressure chamber arrangement area
12: First individual flow path
14: Second individual flow path
20: First common flow path (Common flow path)
20*a*: Opening (of first common flow path)
22: First integration flow path
22*a*: First integration flow path body
22*c*: Opening (of first integration flow path)
24: Second common flow path (common flow path)
24*a*: Opening (of second common flow path)
25, 125: Connection flow path
26: Second integration flow path
26*a*: Second integration flow path body
26*c*: Opening (of second integration flow path)
28A: First damper
28B: Second damper
29: Damper chamber
30: End flow path
30*a*: Widened portion
30*b*: Narrowed portion
30*c*, 30*d*: Opening (of end flow path)
40: Piezoelectric actuator board
40*a*: Piezoelectric ceramic layer
40*b*: Piezoelectric ceramic layer (Diaphragm)
42: Common electrode
44: Individual electrode
44*a*: Individual electrode body
44*b*: Drawn electrode
46: Connection electrode
50: Displacement element (Pressure section)
60: Signal transmission unit
70: Head-mounted frame
72: Head group
80A: Feed roller
80B: Collection roller
82A: Guide roller
82B: Conveyance roller
88: Control unit
A1: First bonding area
A2: Second bonding area B1: First extended area
B2: First extended area
C: Connection range
C1: First connection range
C2: Second connection range
P: Printing sheet

The invention claimed is:

1. A liquid discharge head comprising: a flow path member including a plurality of discharge holes, a plurality of pressure chambers linked to the respective discharge holes, a plurality of first common flow paths, and a plurality of second common flow paths; and a plurality of pressure sections that press the respective pressure chambers, wherein when viewed in a plan view, the first common flow paths and the second common flow paths extend in a first direction, and are alternately arranged in a second direction that crosses the first direction, the first common flow paths are opened to outside of the flow path member at ends in the first direction, are not opened to outside of the flow path member at ends in a third direction that is opposite to the first direction, the second common flow path is opened to outside of the flow path member at ends in the third direction, and are not opened to outside of the flow path member at ends in the first direction, the plurality of pressure chambers are disposed between the first common flow paths and the second common flow paths that are adjacent to each other in the second direction, and the first common flow paths and the second common flow paths are linked via the plurality of the pressure chambers, in the first direction, given that a range in which the first common flow path is linked to the second common flow path via the plurality of the pressure chambers is a connection range, the first common flow paths and the second common flow paths are linked via connection flow paths outside the connection range in the first direction, the flow path member is configured by laminating a plurality of flat plates having at least one of holes and grooves, the flow path member includes a first plate having at least one of the holes and grooves that constitute the connection flow paths and having at least one of the holes and grooves that constitute the first common flow path and second common flow paths, and a second plate having at least one of the holes and grooves that constitute the connection flow paths and having no holes and grooves that constitute the first common flow paths and second common flow paths.

2. The liquid discharge head according to claim 1, wherein the flow path member includes a third plate having at least one of the holes and grooves that constitute the pressure chambers, and the second plate is located on the third plate side with respect to the first plate in the lamination direction.

3. The liquid discharge head according to claim 1, wherein at least one of a connecting position between the first common flow path and the connection flow path and a connecting position between the second common flow path and the connection flow path is arranged on a side wall of the first common flow path or the second common flow path, the side wall extending in the first direction and in the lamination direction of the plates.

4. A recording device comprising: the liquid discharge head according to claim 1; a conveyance unit that conveys a recording medium to the liquid discharge head, and a control unit that controls the liquid discharge head.

* * * * *